US007176840B1

(12) United States Patent
Kelley

(10) Patent No.: US 7,176,840 B1
(45) Date of Patent: Feb. 13, 2007

(54) VARIABLE SPACING INDUCTANCE COIL APPARATUS AND METHOD

(76) Inventor: Michael Peter Kelley, 4511 Artesia Dr., Paso Robles, CA (US) 93446

( * ) Notice: Subject to any disclaimer, the term of this patent is extended or adjusted under 35 U.S.C. 154(b) by 133 days.

(21) Appl. No.: 10/907,640

(22) Filed: Apr. 8, 2005

(51) Int. Cl.
*H01Q 9/00* (2006.01)
*H01Q 1/36* (2006.01)

(52) U.S. Cl. ..... 343/745; 343/750; 343/895; 336/115

(58) Field of Classification Search ..... 336/115, 336/122, 125; 343/745, 750, 749, 895, 725
See application file for complete search history.

(56) References Cited

U.S. PATENT DOCUMENTS

| | | | | |
|---|---|---|---|---|
| 1,819,904 | A | | 8/1931 | Love |
| 2,103,646 | A | | 12/1937 | Schlesinger |
| 2,839,752 | A | | 6/1958 | Webster |
| 2,855,599 | A | | 10/1958 | Kandoian |
| 2,874,274 | A | | 2/1959 | Adams et al. |
| 2,894,260 | A | | 7/1959 | Ellis |
| 2,993,204 | A | | 7/1961 | Macalpine |
| 3,226,725 | A | | 12/1965 | Ritchie et al. |
| 3,264,647 | A | | 8/1966 | Nuttle |
| 3,541,554 | A | | 11/1970 | Shirey |
| 3,653,053 | A | | 3/1972 | St. Vrain et al. |
| 3,671,927 | A | * | 6/1972 | Proudian et al. ..... 367/94 |
| 3,798,654 | A | | 3/1974 | Martino et al. |
| 3,999,185 | A | | 12/1976 | Polgar, Jr. et al. |
| 4,064,474 | A | | 12/1977 | Adams et al. |
| 4,080,604 | A | | 3/1978 | Wosniewski |
| 4,117,495 | A | | 9/1978 | Hotchstein |
| 4,139,852 | A | | 2/1979 | Koyanagi |
| 4,163,981 | A | | 8/1979 | Wilson |
| 4,620,194 | A | | 10/1986 | Bel Moratalla |
| 4,958,163 | A | | 9/1990 | Leonard |
| 5,175,526 | A | | 12/1992 | Martin |
| 5,274,393 | A | * | 12/1993 | Scott ..... 343/895 |
| 5,883,600 | A | | 3/1999 | Kukura |
| 5,990,841 | A | | 11/1999 | Sakamoto et al. |
| 6,275,195 | B1 | | 8/2001 | Gyenes |
| 6,496,154 | B2 | | 12/2002 | Gyenes |

OTHER PUBLICATIONS

Robert E. Snyder, An Efficient Tuner for Small 160 Meter Verticals (Apr. 2005), published in QST, the official journal of AARL, the national association for amateur radio, copies available from AARL Publication Sales Department, 225 Main Street, Newington, CT 06111-1494, 1-888-277-5289 (Inside USA) or 1-860-594-0355.

* cited by examiner

*Primary Examiner*—Anh Mai
(74) *Attorney, Agent, or Firm*—William Keyworth; Bill & Mary Lou Inc.

(57) ABSTRACT

A variable inductance electrical device is an electrical conductor arranged in a flexible helical coil with a multiplicity of windings connected to a traveler plate and a fixed plate coaxially arranged a distance from the traveler plate. The conductor is arranged in the space between the traveler plate and the fixed plate such that moving the traveler plate away from the fixed plate moves the conductor coils apart and moving the traveler plate towards the fixed plate moves the conductor coils closer together. The inductance of the electrical coil varies inversely with the length of the coil, and thus varies with the spacing of the coils.

25 Claims, 9 Drawing Sheets

VARIABLE SPACING INDUCTANCE COIL APPARATUS AND METHOD

CROSS-REFERENCE TO RELATED APPLICATIONS

Not Applicable.

STATEMENT REGARDING FEDERALLY SPONSORED RESEARCH AND DEVELOPMENT

Not Applicable.

REFERENCE TO A MICROFICHE APPENDIX

Not Applicable.

BACKGROUND OF THE INVENTION

1. Field Invention

This invention relates to an apparatus and method for varying the inductance of an electrical circuit by changing the spacing of the inductance coil windings.

2. Description of Related Art

Devices for varying electrical inductance are known in the art. Frequently such devices are used to tune antenna circuits to obtain resonance at a desired frequency. Typically an antenna is designed for a specific frequency, by sizing the active members of the antenna, and is effective for a range of frequencies usually centered on that specific resonant frequency. Some antenna designs have multiple resonant frequencies, and some are relatively effective over a very broad range of frequencies. Others, due to size limitations, are short relative to the desired wavelength and require an inductive load to offset the capacitive load provided by the shortness of the antenna compared to the desired frequency. Increasing or decreasing the inductance on the antenna with a loading device, assuming the physical length of the antenna is electrically short, decreases or increases the resonant frequency respectively. Several devices for varying the inductance of an antenna have been taught.

A common device to vary inductance is to have an inductor of fixed length which has the effective length adjusted by a contact, or contacts, that move along the length of the inductor coil, varying the active length by shorting the coil at the location of the contact. A problem with this type of device is the need to provide frequent maintenance of the contacts and coil to keep them clean and free of corrosion so as to provide good conductivity. Examples of this type of device are taught in U.S. Pat. No. 2,103,646 (Schlesinger), U.S. Pat. No. 2,855,599 (Kandoian), U.S. Pat. No. 2,874,274 (Adams et al.), U.S. Pat. No. 2,993,204 (Macalpine), U.S. Pat. No. 3,999,185 (Richie et al.), U.S. Pat. No. 4,117,495 (Hotchstein), U.S. Pat. No. 4,620,194 (Bel Moratalla), U.S. Pat. No. 4,958,163 (Leonard), U.S. Pat. No. 5,175,526 (Martin), and U.S. Pat. No. 5,990,841 (Sakamoto et al.). An alternative to the moveable contact is a tapped inductor, consisting of a helical wound coil with conductors attached at specific winding locations along the coil. These conductors are then connected to a multi-position switch external to the coil that is used to select the amount of inductance. This arrangement moves the maintenance requirement from the coil contact to the switch contact. Devices that commonly use tapped inductors are tuning circuits in RF linear amplifiers and common antenna tuners used to match a non-resonant antenna to a transmitter.

These contact devices are common in manually adjusted antennas also. U.S. Pat. No. 2,839,752 (Webster), U.S. Pat. No. 2,894,260 (Ellis), U.S. Pat. No. 3,653,053 (St. Vrain et al.), U.S. Pat. No. 3,798,654 (Martino et al.), U.S. Pat. No. 4,064,474 (Adams et al.), U.S. Pat. No. 4,080,604 (Wosniewski), U.S. Pat. No. 4,958,163 (Leonard), U.S. Pat. No. 6,275,195 (Gyenes) and U.S. Pat. No. 6,496,154 (Gyenes) are examples. U.S. Pat. No. 4,163,981 (Wilson) shorts the end coils of the inductor together to vary the effective length as an alternative to a contactor, however this has the same potential for corrosion as a contact.

Devices that do not use contacts may move two coils relative to each other to adjust inductance, such as U.S. Pat. No. 1,819,904 (Love) and U.S. Pat. No. 3,541,554 (Shirey). Alternately the inductance coil may be wound as the antenna is adjusted such as U.S. Pat. No. 3,226,725 (Ritchie et al.) and U.S. Pat. No. 4,139,852 (Koyanagi). Another scheme is to move a metallic or ferrite core inside the inductance coil as in U.S. Pat. No. 3,264,647 (Nuttle). The disadvantage of this is such core inductors have objectionable non-linear effects. These schemes also have complicated mechanisms and/or have undesirable electrical characteristics reducing their effectiveness.

SUMMARY OF THE INVENTION

This variable inductance electrical apparatus is an electrical conductor arranged in a flexible helical coil with a multiplicity of helical windings connected to a traveler plate and a fixed plate coaxially arranged substantially parallel to, and a desired distance from, the traveler plate. The inductor is manufactured by arranging the conductor coil in the space between the traveler plate and the fixed plate such that moving the traveler plate away from the fixed plate moves the inductor coils symmetrically apart and moving the traveler plate towards the fixed plate moves the inductor coils symmetrically closer together. Means for moving the traveler plate relative to the fixed plate are incorporated. Connections to incorporate the helical coil in an electrical circuit are attached to the coil at the coil connections to the traveler and fixed plates. This method of varying the inductance of the electrical coil varies the inductance inversely with the length of the coil, and thus varies inversely with the spacing between the coils.

OBJECTS AND ADVANTAGES

An object of this invention is to provide a variable inductance that may be easily and reliably adjusted but does not require electrical contacts or introduce undesirable electrical characteristics.

BRIEF DESCRIPTION OF THE SEVERAL VIEWS OF THE DRAWINGS

A more complete understanding of the present invention can be obtained by considering the detailed description in conjunction with the accompanying drawings, in which.

REFERENCE NUMERALS IN DRAWINGS

Figure 1:
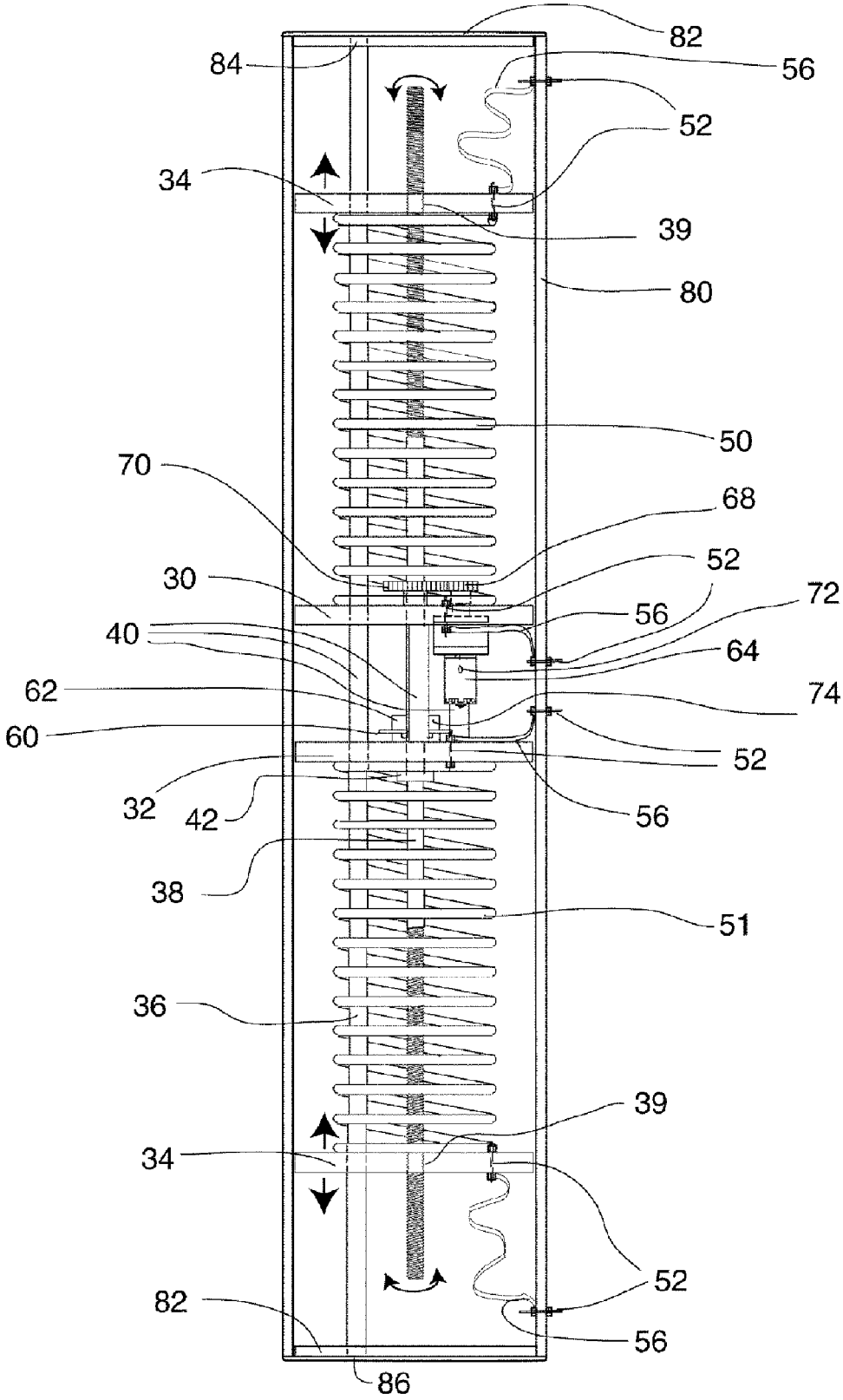
FIG. 1 is a side view of the variable spacing inductance coil showing a two coil arrangement in an expanded coil spacing position. The weather resistant casing is cut away at the location marked A—A on FIG. 7.

These reference numbers are used in the drawings to refer to areas or features of the invention.

30 Fixed Plate
31 Central Axis
32 Lower Fixed Plate
34 Traveler Plate
36 Guide Rod
37 Lead Screw Opening in the Fixed Plate and Lower Fixed Plate
38 Lead Screw
39 Lead Screw Threaded Engagement with Traveler Plate
40 Fixed Plate Spacing Rod
42 Lead Screw Thrust Collar Bearing
50 Inductor Coil
51 Lower Inductor Coil
52 Inductor Coil Electrical Connection
56 Inductor Coil Electrical Lead
60 Encoder Wheel
62 Encoder
64 Electric Motor
68 Motor Gear
70 Lead Screw Drive Gear
72 Motor Electrical Connection
74 Encoder Electrical Connection
80 Casing
82 Casing End Fitting
84 Upper Guide Rod Mounting Boss
86 Lower Guide Rod Mounting Boss
100 Vertical Dipole Radio Antenna
101 Antenna Feed Point
102 Antenna Non-conductive Guy Wires
103 Antenna Mast Insulator
104 Variable Spacing Inductance Coil
106 Antenna Mast
110 Short Switch Adjustable Contact
112 Short Switch Fixed Contact
120 Guide Rod Opening
121 Electric Motor Mounting Screw Holes
122 Spacing Rod Opening
124 Short Switch Mounting Opening
126 Inductor Coil Electrical Lead Opening
128 Short Switch Electrical Connection

DETAILED DESCRIPTION OF THE INVENTION

The variable spacing inductance coil apparatus is shown in FIG. 1. The basic apparatus consists of an inductor coil (50), made of a flexible conductor, electrically and mechanically attached to a traveler plate (34) and a fixed plate (30). The traveler plate and fixed plate are connected by a lead screw (38). The lead screw is threaded for a part of its length and the threads mate with internal threads on the traveler plate so the traveler plate is threadedly connected (39) to the lead screw. Turning the lead screw in one direction moves the traveler plate away from the fixed plate on the lead screw threads and turning the lead screw in the other direction moves the traveler plate towards the fixed plate on the lead screw threads. The traveler plate remains substantially parallel to the fixed plate at any position on the lead screw due to both plates being connected to the lead screw. The lead screw shaft has a lead screw thrust collar bearing (42) to retain the lead screw connected to the fixed plate while allowing it to rotate.

Figure 2:
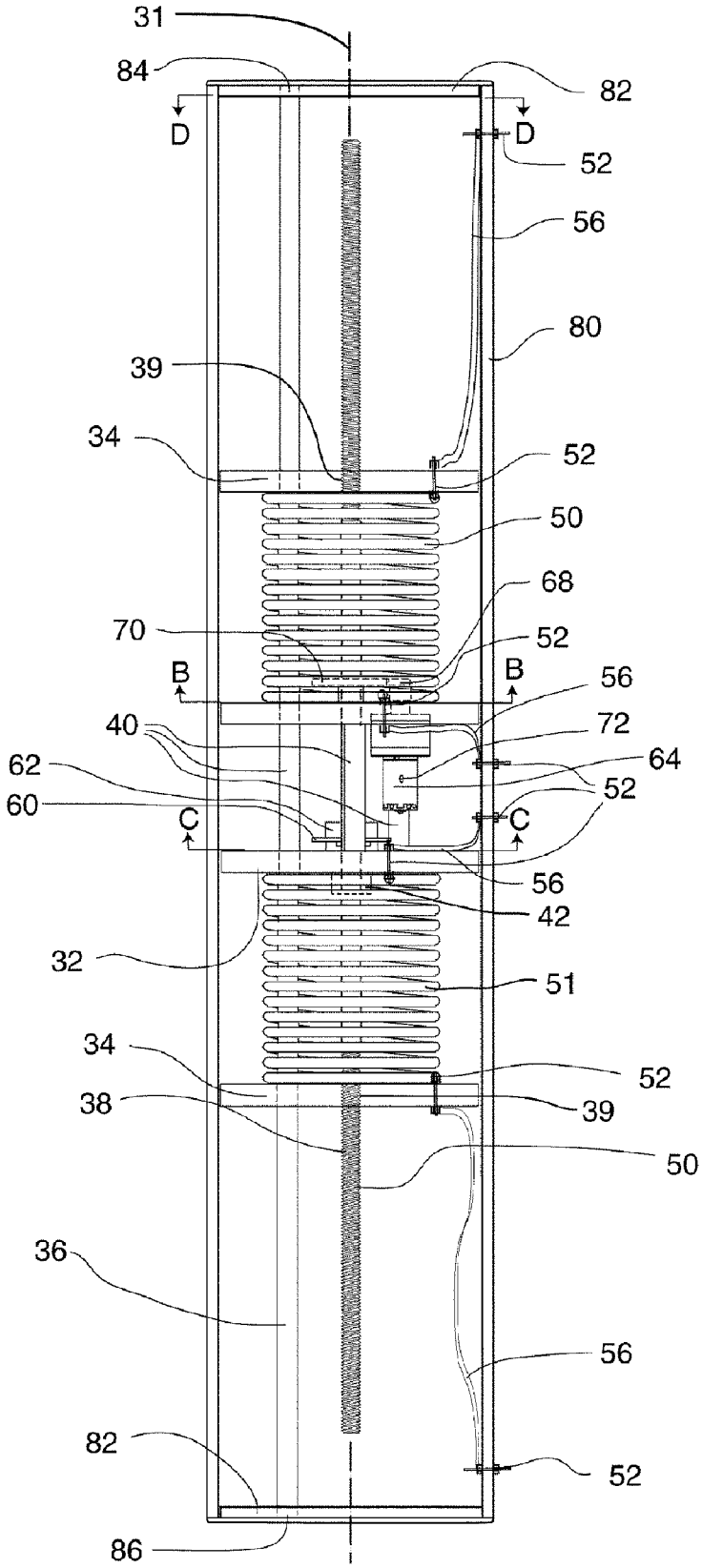
FIG. 2 is a side view of the variable spacing inductance coil showing a two coil arrangement in a fully contracted position. The weather resistant casing is cut away at the location marked A—A on FIG. 7.

The coil is in a position where there is space between the windings of the coil in FIG. 1. In FIG. 2 the lead screw (38) has been turned to move the traveler plate (34) towards the fixed plate on the lead screw threads. This movement relocates the flexible coil windings to reduce the spacing between the windings, decreasing the length of the coil while keeping the same number of windings, in other words, turns of the conductor. The reduced spacing increases the inductance of the coil. FIG. 1 therefore shows the coil in a position of low inductance; FIG. 2 shows the coil in a position of high inductance. The method of varying inductance in the invention is to change the spacing between the flexible windings of a coil thus varying the length of the coil and varying the inductance property. Doubling the length of a coil while keeping the same number of windings approximately halves the value of inductance of the coil as shown by the following formula:

$$L = N^2\left(\frac{d^2}{18d + 40b}\right)$$

Where:
L=Inductance
d=Inductor Coil Diameter in Inches
b=Inductor Coil Length in Inches
N=Number of Inductor Coil Turns The embodiment of the variable spacing inductance coil apparatus shown in FIG. 1 and FIG. 2 incorporates two electrical inductor coils, the upper one (50) and a lower one (51), each connected electrically and mechanically to traveler plates (34) and fixed plates, (30) and (32) at the electrical connection (52) shown on the plates. The lower fixed plate (32) is connected to the fixed plate (30) by fixed plate spacing rods (40) to maintain the relative position of the two fixed plates. The central axis of the plates substantially coexists with the central axis around which the inductor coils are wound. FIG. 2 shows this central axis (31). The lead screw (38) is threaded at each end and is threadedly connected (39) to the traveler plates, and the central axis (31) of the lead screw substantially coexists with the central axis of the plates in the embodiment shown. Rotation of the lead screw (38), as shown in FIG. 1, causes movement of both traveler plates at the same time; either towards the fixed plates, to symmetrically reduce the spacing of the coil windings by moving the windings closer together as shown in FIG. 2, or away from the fixed plates, to symmetrically move the windings apart and increase the spacing of the coil windings, as shown in FIG. 1. The symmetrical change in length of the inductor coils is used in this application to describe a change in the distance to the adjacent coils that is substantially uniform around the circumference of a particular coil. Symmetrical motion of the windings allows accurate inductor sizing calculations.

The lead screw (38) is supported by, and connected to the fixed plate, by a thrust collar bearing (42). The thrust collar bearing permits rotation of the lead screw while maintaining the lead screw substantially at a right angle to the fixed plate. The lead screw is rotated by the turning of a lead screw gear (70) by an electric motor (64) connected to the lead screw by a motor gear (68). The motor electrical connection (72) may be connected to controls allowing the motor to be operated remotely. Rotational movement of the lead screw (38) can be detected by an encoder wheel (60) and encoder (62) connected to a remote display to give the operator an indication of the traveler plate position on the lead screw. Depending on application, the upper electric inductor coil (50) and lower electric inductor coil (51) may be connected at the center by the inductor coil electrical connectors (52) and inductor coil electrical leads (56) to operate in series, or may operate electrically independent.

In this embodiment, as shown in FIG. 1 and FIG. 2, the variable spacing inductance coil apparatus is installed in a cylindrical casing (80) with casing end fittings (82) at each end of the casing cylinder. The end fittings (82) and the electrical connections (52) through the casing are made to protect the variable spacing inductance coil apparatus from adverse weather when the apparatus is used outdoors. A guide rod (36) connects to each end fitting (82) at the upper (82) and lower (84) guide rod mounting boss, and is assembled through openings in the traveler plates (34) and the fixed plate (30) and lower fixed plate (32). The guide rod prevents rotation of the traveler plates when the lead screw is rotated. These openings are shown in the fixed plate in FIG. 3, the lower fixed plate (32) in FIG. 4 and the traveler plate (34) in FIG. 5. A guide rod mounting boss (84, 86) is on the upper and lower casing end fittings (82) as shown in FIG. 6. The locations of the mounting boss (84, 86) are also shown in FIGS. 1 and 2.

Figure 3:
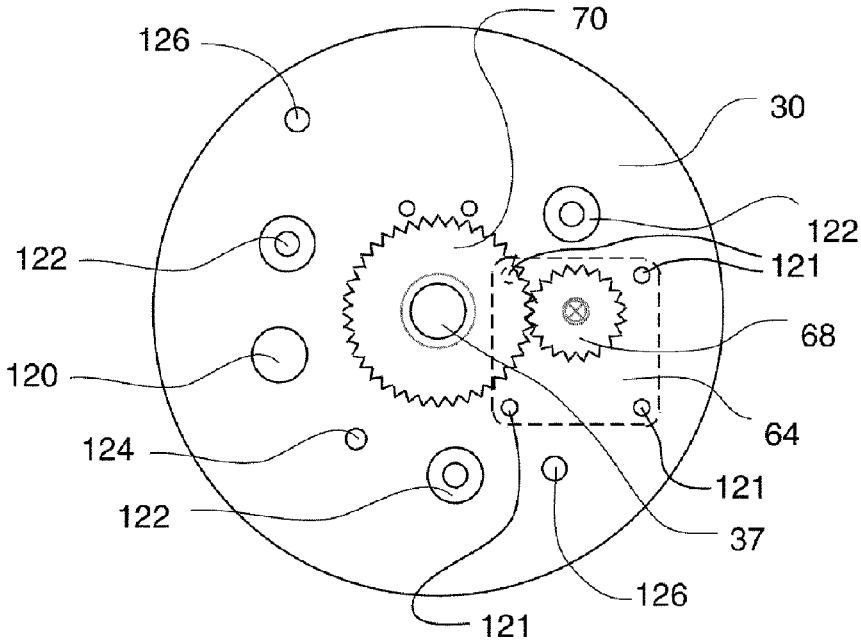
FIG. 3 is a top view of the upper fixed plate at the location B—B on FIG. 2.

The fixed plate layout shown in FIG. 3 has a lead screw (38) opening (37) that permits the lead screw to turn within the opening. The lead screw drive gear (70) is connected to the lead screw and is driven by the motor gear (68). The electric motor (64) is shown in a broken line as it is mounted on the underneath surface of the fixed plate as shown in FIG. 1 and FIG. 2. The mounting openings (121) for the electric motor are shown. The guide rod opening (120) is located so as to be between the lead screw and the inner circumference of the inductor coil. There are three spacing rod openings (122), also located so as to be between the lead screw and the inner circumference of the inductor coil. They are offset from the guide rod opening as shown. The spacing rods connect the fixed plate with the lower fixed plate as shown in FIG. 1 and FIG. 2. The rods are fastened to the fixed plate and lower fixed plate by fasteners (example a common screw). The electric inductor coil electrical lead (56), shown in FIG. 1 and FIG. 2, is assembled in one of the inductor coil electrical lead openings (126) shown in FIG. 3.

Figure 4:
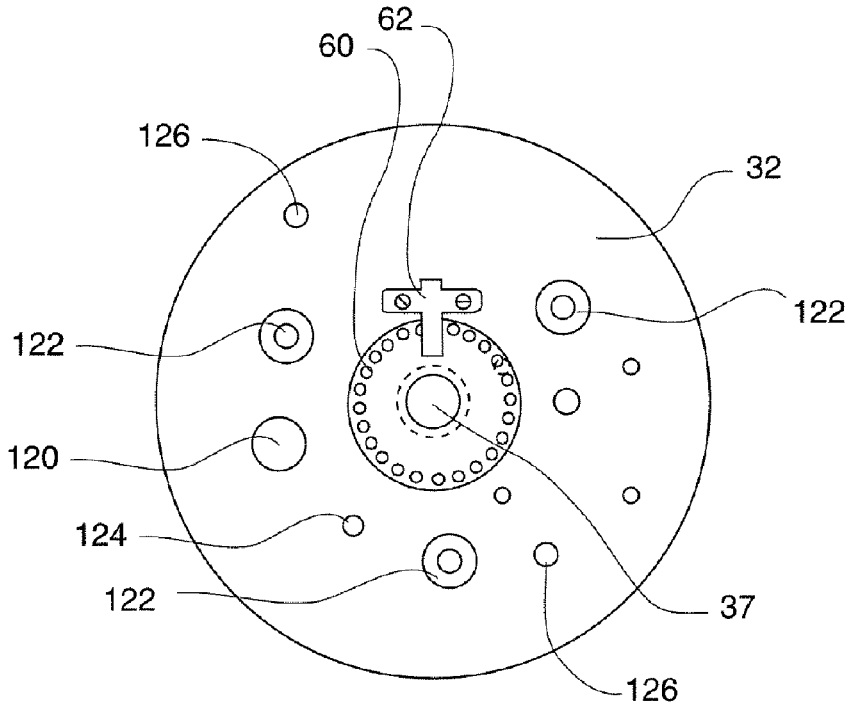
FIG. 4 is a top view of the lower fixed plate at the location C—C on FIG. 2.

The lower fixed plate (32), shown in FIG. 4, is a similar layout to the fixed plate, described previously. The lower fixed plate has the encoder (62) located adjacent to the encoder wheel (60) that is mounted on the lead screw (38) as shown in FIGS. 1 and 2. The thrust collar bearing is mounted to the bottom of this plate, as indicated, and shown in FIGS. 1 and 2.

Figure 5:
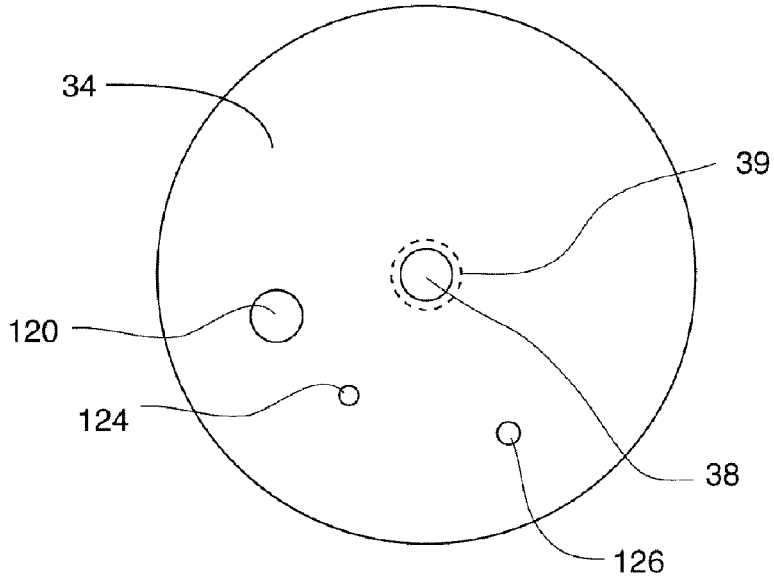
FIG. 5 is a top view of a traveler plate.
Figure 6:
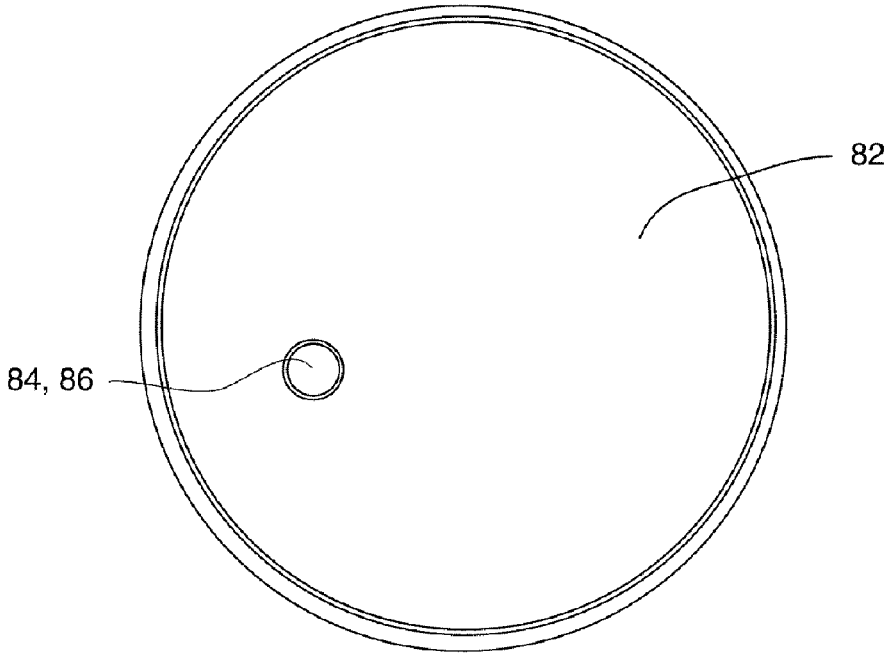
FIG. 6 is an inner view of a casing end fitting at the location D—D on FIG. 2.

The traveler plates (34) layout is shown in FIG. 5. Its lead screw (38) opening is internally threaded (39) so the traveler plate will move along the axis of the lead screw when the lead screw is rotated relative to the traveler plate. The guide rod (36), shown in FIG. 1 and FIG. 2 passes through the guide rod opening (120) in the traveler plate and prevents rotation of the traveler plate with rotation of the lead screw. The electric inductor coil electrical lead (56), shown in FIG. 1 and FIG. 2, is assembled in the inductor coil electrical lead openings (126) shown in FIG. 5.

The casing end fitting layout is shown in FIG. 6. It has a guide rod bushing (130) that maintains the end of the guide rod in the desired position in the casing (80) shown in FIG. 1 and FIG. 2.

Figure 7:
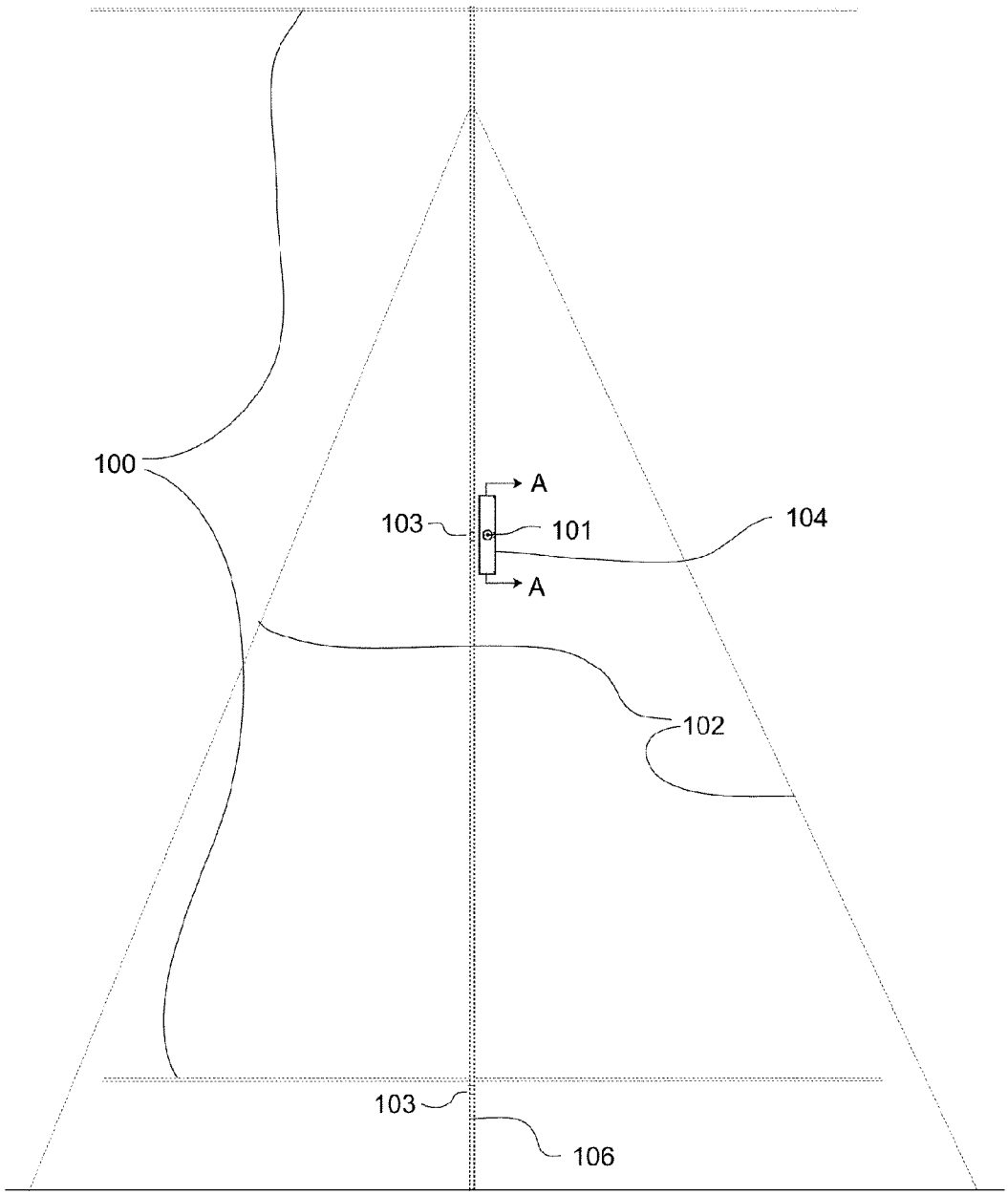
FIG. 7 is a front view of the variable spacing inductance coil showing an application to adjust the impedance of a dipole radio transmission antenna. A two-coil variable spacing inductance coil is mounted in a weather-resistant casing attached to the antenna mast.

An application of the variable spacing inductance coil apparatus in the embodiment described above to a short wave radio transceiver vertical dipole antenna (100) intended for use in the 80/75 meter band is shown in FIG. 7. In this application the lead screw, traveler plate, fixed plates, casing, and casing end fitting are constructed of non-conductive (e.g. dielectric), non-magnetic material that provides an air core inductor. The antenna has a mast (106) supporting the antenna elements and electrically insulated from ground by an insulator (103) and also electrically separated at the antenna feed point (101) by an insulator (103). The mast has nonconductive guy lines (102) providing support.

Additional Embodiments

Figure 8:
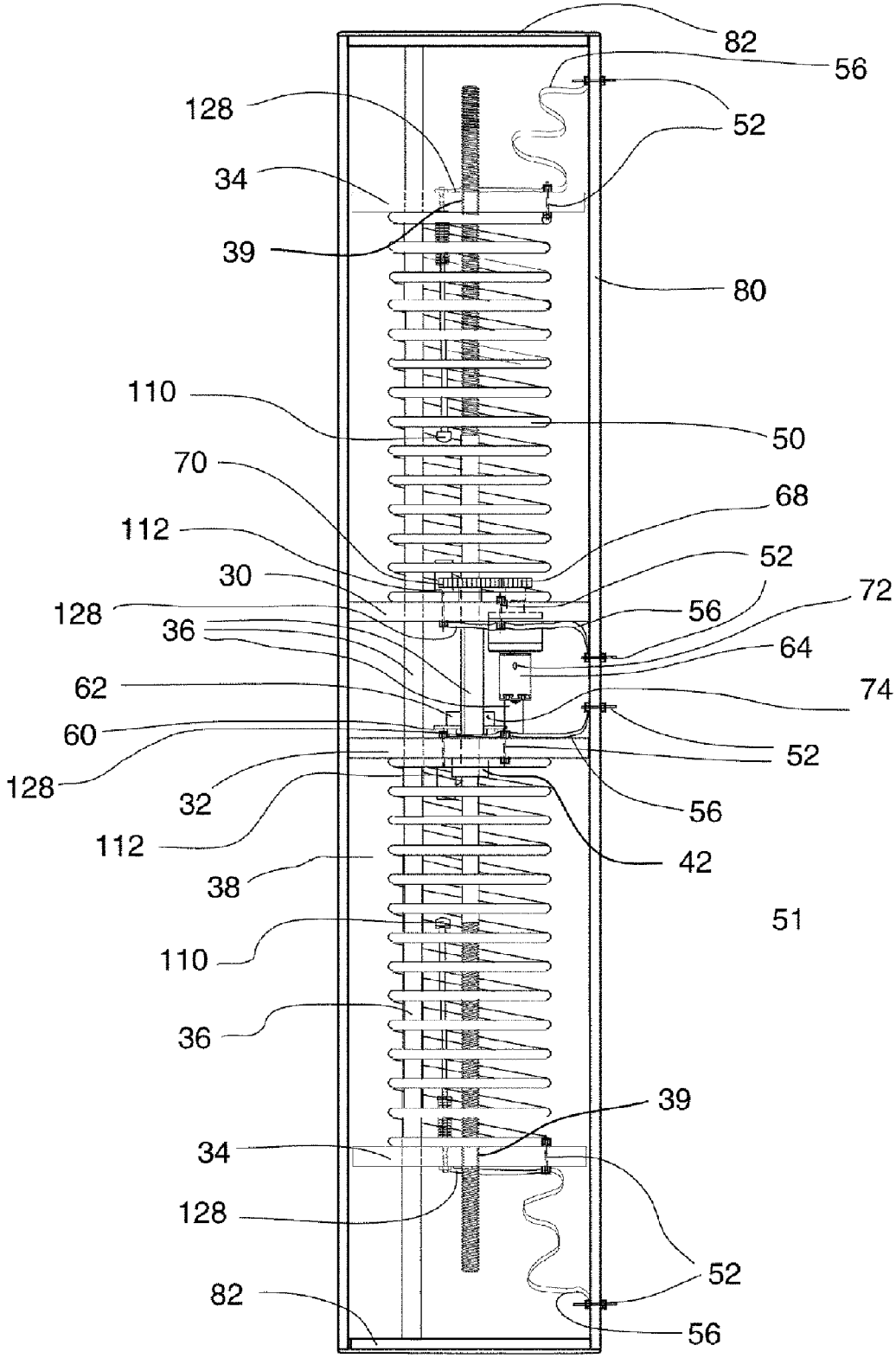
FIG. 8 is a side view of an embodiment of the variable spacing inductance coil with a coil shorting switch. The coil shorting switch is in a position with the coil in service.
Figure 9:
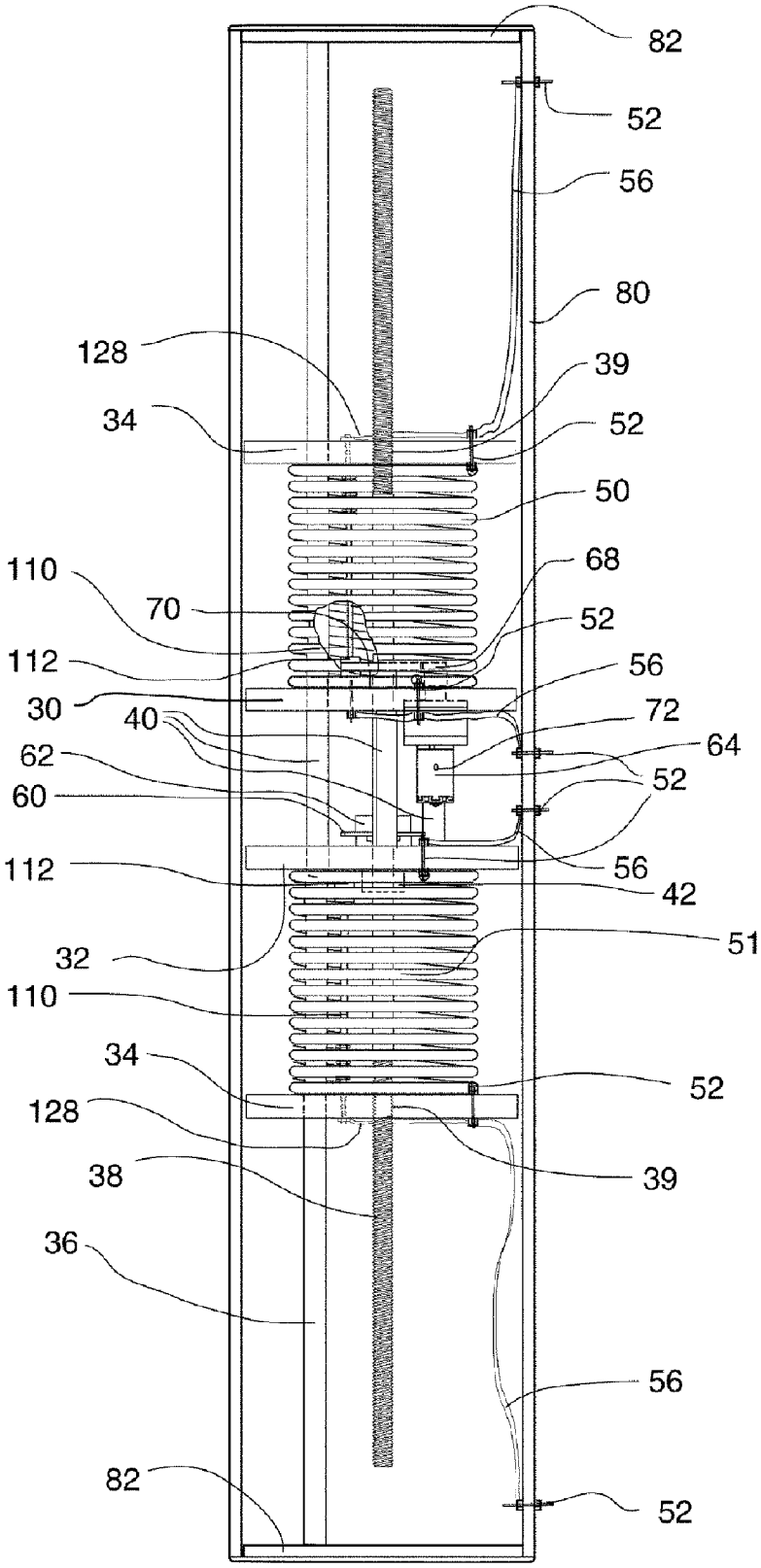
FIG. 9 is a side view of an embodiment of the variable spacing inductance coil with a coil shorting switch. The coil shorting switch is in a position with the coil shorted by the switch. A cut-away of the electrical conductor in the upper inductor coil shows the closed shorting switch.

An embodiment of the variable spacing inductance coil apparatus incorporating a short switch is shown in FIGS. 8 and 9. These apparatus are identical to the embodiment shown in FIG. 1 and FIG. 2 with the addition of a short switch adjustable contact (110) mounted on the traveler plate (34) and a short switch fixed contact (112) mounted on the fixed plate (30) and the lower fixed plate (32) in the locations (124) shown in FIGS. 3 and 4. The short switch contacts are wired in parallel to the inductor coil (50) by the short switch electrical connections (128). The short switch contacts are apart when the traveler plate motion moves the adjustable short switch contact away from the fixed plate (or lower fixed plate), as shown in FIG. 8. In this position there is no electrical conduction path through the short switch and the variable spacing inductance coil apparatus will operate as described previously. If the traveler plate is moved to a position where the adjustable contact (110) is engaged, that is touching the fixed contact (112) as shown in FIG. 9, the short switch provides an electrical conduction path around the variable spacing inductance coil.

In the application shown in FIG. 7, adjusting the variable spacing inductance coil apparatus so the short switch is engaged permits effective operation of the 80/75 meter band antenna in the 40 meter band.

Figure 10:
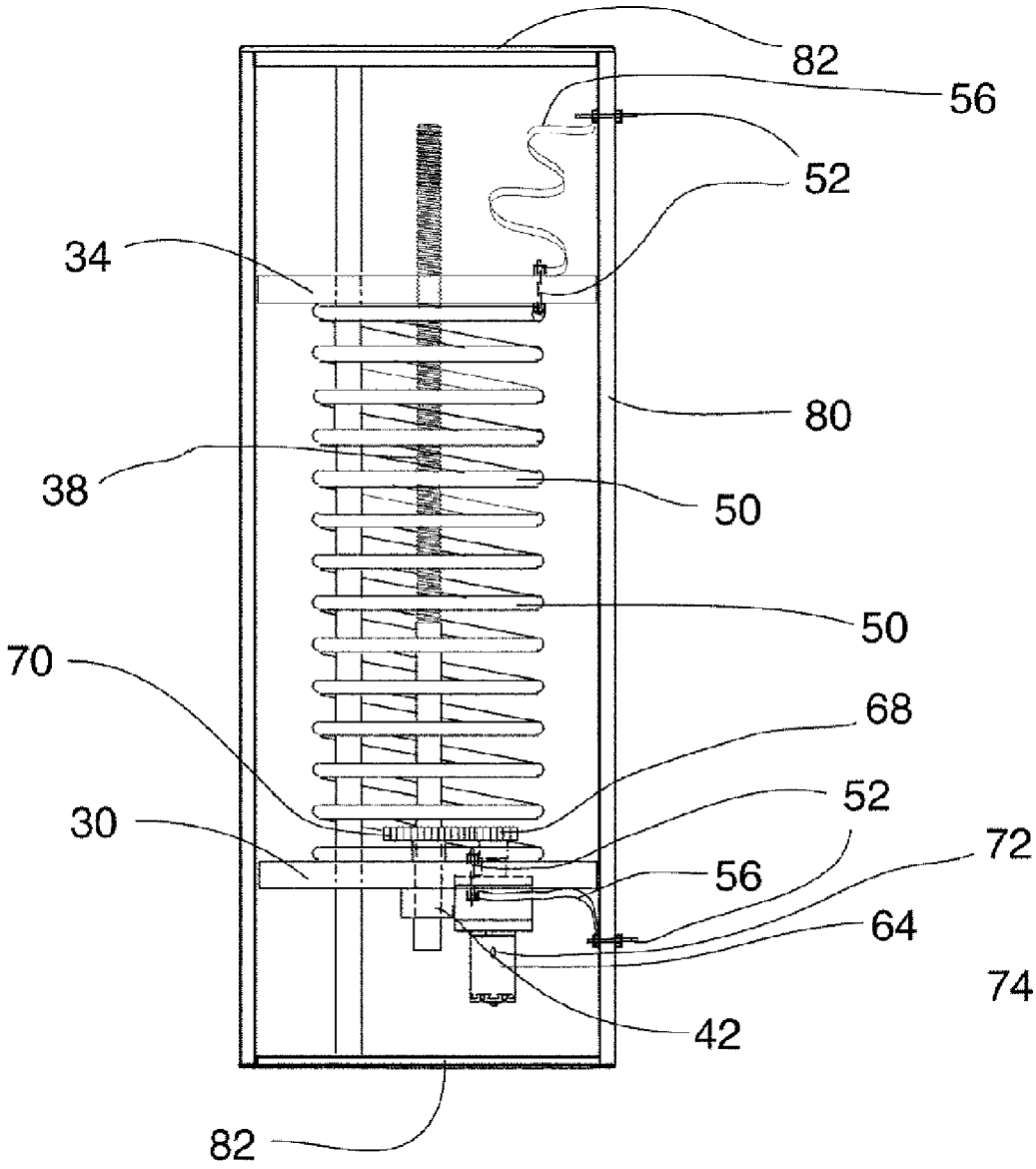
FIG. 10 is a side view of an embodiment of the variable spacing inductance coil with a single coil.

An embodiment of the variable spacing inductance coil apparatus incorporating a single Inductor coil is shown in FIG. 10. This embodiment uses a single fixed plate rather than two fixed plates.

Figure 11:
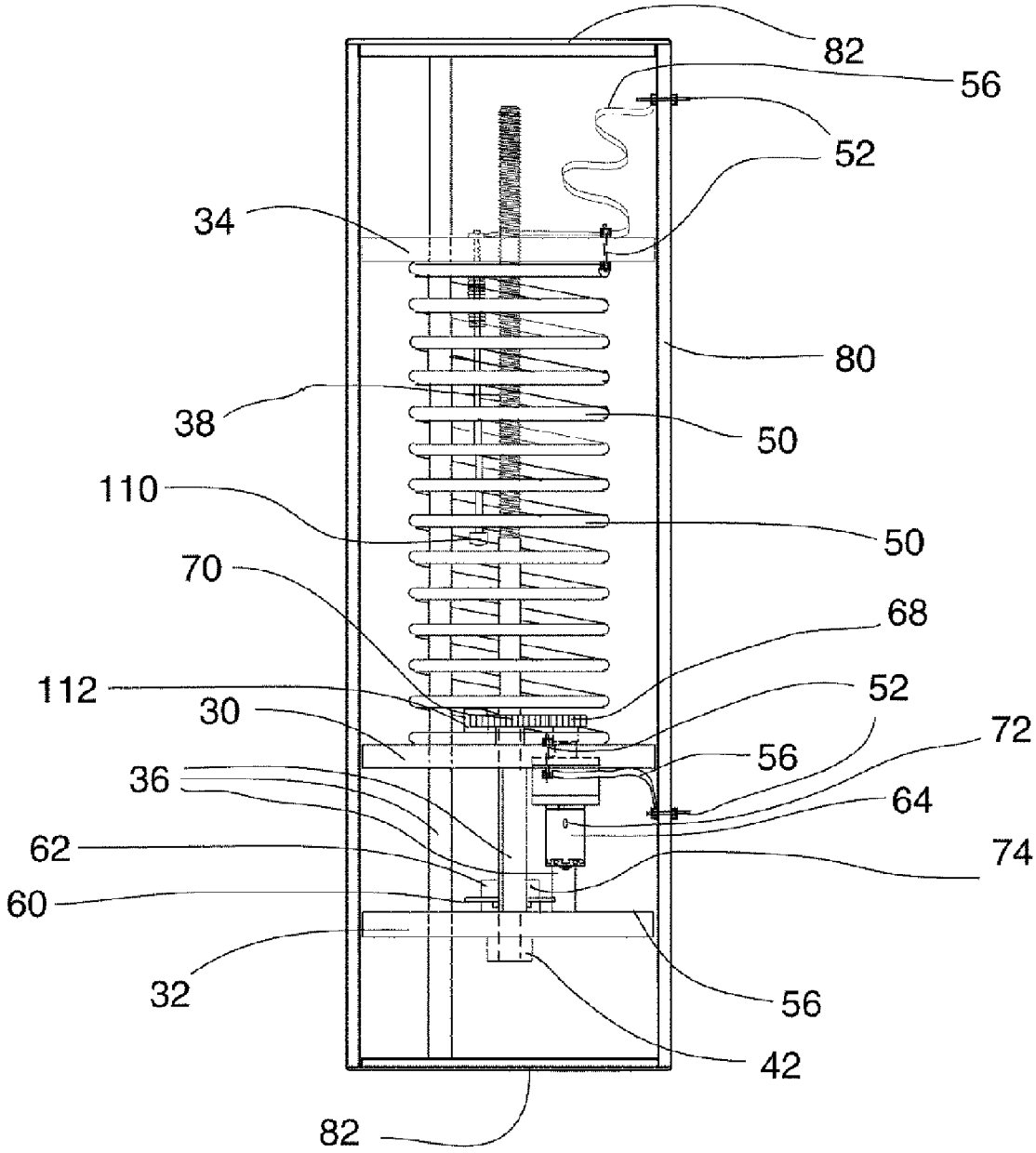
FIG. 11 is a side view of an embodiment of the variable spacing inductance coil with a single coil and also employing a coil shorting switch. The coil shorting switch is in a position with the coil in service.

Another embodiment, shown in FIG. 11, is to incorporate a short switch in a single coil embodiment similar to that shown in FIG. 10. This embodiment is identical to the embodiment shown in FIG. 8 and FIG. 9 with the lead screw modified to engage only a single traveler plate (34) as shown in FIG. 10.

Those familiar with the art recognize there are many possible applications and embodiments for the variable spacing inductance coil apparatus. Examples that will be apparent are devices that commonly use tapped inductors, such as tuning circuits in RF linear amplifiers and common antenna tuners used to match a non-resonant antenna to a transmitter. Some applications may be suitable for manually positioning the windings, such as by turning the leadscrew, rather than using an electric motor. The above recitation of the preferred and other embodiments is not intended to define or constrain the invention, rather the claims define the invention.

Operation

The dipole antenna with variable spacing inductance coil apparatus, shown in FIG. 7, has the transmission line from the transceiver (not shown) connected near the middle of the antenna mast and feeding each antenna segment (top and bottom) through the variable spacing inductance coil apparatus arranged with two coils and equipped with short switch contacts (110, 12), and an encoder (62), as shown in FIGS. 8 and 9. The encoder output is transmitted back to the transceiver location and the electric motor (72) is operated from the transceiver location.

Varying the inductance of the variable spacing inductance coil apparatus is used to tune the antenna's resonance to allow the antenna to properly radiate the power from the transceiver. The antenna resonance is a variable depending on the antenna type, length, and the inductance of the variable spacing inductance coil apparatus. The need to adjust the inductance will vary with the frequency at which the radio transceiver is operating. The effectiveness of tuning the circuit with the variable spacing inductance coil apparatus is measured using a common standing wave ratio (SWR) meter which approximates the voltage standing wave ratio, a measure of the impedance mismatch between the transmission line and antenna. An ideal SWR is 1:1, and a practical goal is 1.5:1. Depending on the feed point impedance of the antenna and other variables such as the antenna's proximity to objects such as buildings, the SWR meter reading may be higher than optimal; nevertheless the variation in the meter reading follows the variation in the SWR and so a dip in the meter reading will indicate resonance of the antenna at the new operating frequency.

The variable spacing inductance coil apparatus coil spacing is increased to reduce the inductance of the coil, and similarly the coil spacing is decreased to increase the impedance of the coil. Generally for an antenna designed for a particular frequency range, as for example the 80/75 meter band antenna shown in FIG. 7, more inductance of the coil is needed at the lower frequency (longer wavelength) portion of the band, and, since the antenna is short, about 36 feet (approximately 11 meters), compared to the wavelength, inductance is needed to resonate the antenna over the frequency range (3.500 to 4.000 MHZ).

When increasing operating frequency, the variable spacing inductance coil apparatus coil spacing is increased. Operating the motor in the direction to move the traveler plates (34) away from the fixed plates (32, 34) provides this spacing increase. Similarly, when decreasing operating frequency, the variable spacing inductance coil apparatus coil spacing is decreased. Operating the motor in the direction to move the traveler plates (34) toward the fixed plates (32, 34) provides this spacing decrease. The encoder position indication may be calibrated for use in determining the approximate position of the traveler plates in relation to the fixed plates for the frequency desired. The SWR meter then is observed when making further fine adjustments to optimize the coil spacing for the new operating frequency.

Since the variable spacing inductance coil apparatus is equipped with short switch contacts (110, 112), the 80/75 meter antenna may be used as a one-quarter wave 40 meter antenna by decreasing the coil spacing to the compression limit. This engages the short switch contacts taking the coils out of the circuit. Since the 40 meter frequency band is approximately one-half the wavelength of the 80/75, no further adjustment of the variable spacing inductance coil apparatus is needed to effectively operate in this band. A technique sometimes employed to further achieve efficient power transfer from the transceiver to the resonant antenna is a fixed inductance, or L-matching network, commonly called a hairpin, used to adjust the impedance match between the antenna and the transmission line for all operating bands that the antenna is designed for.

What is claimed is:

1. An inductor with variable length comprising:

a. a traveler plate with a central axis and an electrical connection;

b. a fixed plate with a central axis and an electrical connection, the fixed plate coaxially arranged substantially parallel to and a desired distance from the traveler plate;

c. an electrical conductor arranged in a flexible helical coil with a multiplicity of windings substantially around a central axis, a first electrical connection, and a second electrical connection, the first electrical connection attached to the traveler plate electrical connection, the second electrical connection attached to the fixed plate electrical connection, the conductor arranged in the space between the traveler plate and the fixed plate such that moving the traveler plate away from the fixed plate moves the inductor coils symmetrically apart and moving the traveler plate towards the fixed plate moves the inductor coils symmetrically closer together;

d. means for moving the traveler plate away from or towards the fixed plate;

e. an electrical conductor for connecting the traveler plate electrical connection to an electric circuit; and f. an electrical conductor for connecting the fixed plate electrical connection to an electric circuit.

2. The variable electric inductor of claim 1 further comprising the means for moving the traveler plate away from or towards the fixed plate is an electric motor and a lead screw threadedly connected to the traveler plate and connected to the fixed plate by a lead screw thrust collar bearing, the motor arranged to rotate the lead screw.

3. The variable electric inductor of claim 2 further comprising the lead screw central axis substantially coexists with the traveler plate, fixed plate, and coil central axis.

4. The variable electric inductor of claim 3 further comprising the lead screw is a non-conductive material.

5. The variable electric inductor of claim 4 further comprising an encoder wherein the rotations of the lead screw may be remotely decoded.

6. The variable electric inductor of claim 3 further comprising:

a. a lower fixed plate arranged below the first fixed plate;

b. a second coil of flexible electrical conductor arranged with a multiplicity of windings and a first end and a second end, the first end electrically and mechanically connected to the lower fixed plate;

c. a second traveler plate arranged to electrically and mechanically connect to the Inductor coil second end; and d. the lead screw arranged to threadedly connect to the second traveler plate and rotatively traverse the fixed plate lead screw thrust collar bearing wherein rotating the lead screw in one direction moves the second traveler plate away from the lower fixed plate and rotating the lead screw in the opposite direction moves the second traveler plate toward the lower fixed plate.

7. The variable electric inductor of claim 6 further comprising two short switches, each with an adjustable contact and a fixed contact arranged such that closing the contacts provides a short circuit around a coil winding and further arranged such that the contacts close at a set position of the traveler plate relative to the fixed plate.

8. The variable electric inductor of claim 3 further comprising a short switch with an adjustable contact and a fixed contact arranged such that closing the contacts provides a short circuit around the coil windings and further arranged such that the contacts close at a set position of the traveler plate relative to the fixed plate.

9. The variable electric inductor of claim 8 further comprising an encoder wherein the rotations of the lead screw may be remotely decoded.

10. The variable electric inductor of claim 9 further comprising:

a. a lower fixed plate arranged below the first fixed plate;

b. a second coil of flexible electrical conductor arranged with a multiplicity of windings and a first end and a second end, the first end electrically and mechanically connected to the lower fixed plate;

c. a second traveler plate arranged to electrically and mechanically connect to the Inductor coil second end;

d. the lead screw arranged to threadedly connect to the second traveler plate and rotatively traverse the fixed plate lead screw thrust collar bearing wherein rotating the lead screw in one direction moves the second traveler plate away from the lower fixed plate and rotating the lead screw in the opposite direction moves the second traveler plate toward the lower fixed plate; and e. a second short switch with an adjustable contact and a fixed contact arranged such that closing the contacts provides a short circuit around the second coil winding and further arranged such that the contacts close at a set position of the traveler plate relative to the fixed plate.

11. The variable electric inductor of claim 10 further comprising an encoder wherein the rotations of the lead screw may be remotely decoded.

12. The radio transmission and reception antenna variable inductance tuning device of claim 11 further comprising:

a. a second flexible conductor arranged in multiple helical coil windings with a first electrical connection and a second electrical connection;

b. a second traveler plate with a first side and a second side, the first side arranged toward the fixed plate second side, and an electrical connection arranged conductively between the first and second sides and a threaded opening between the first and second sides;

c. the second coil first electrical connection assembled on the fixed plate second side electrical connection and the coil second electrical connection assembled on the second traveler plate first side electrical connection;

d. a conductor from the fixed plate second side electrical connection and a second conductor from the traveler plate second side electrical connection, these conductors arranged to electrically connect the coil between the antenna and the radio; and e. the lead screw arranged to threadedly connect to the second traveler plate and rotatively traverse the lower fixed plate lead screw thrust collar bearing wherein rotating the lead screw in one direction moves the second traveler plate away from the lower fixed plate and rotating the lead screw in the opposite direction moves the second traveler plate toward the lower fixed plate.

13. The radio transmission and reception antenna variable inductance tuning device of claim 11 further comprising a housing arranged with electrical connections for the coil, the motor, and the encoder.

14. The radio transmission and reception antenna variable inductance tuning device of claim 10 further comprising a. a second flexible conductor arranged in multiple helical coil windings with a first electrical connection and a second electrical connection;

b. a second traveler plate with a first side and a second side, the first side arranged toward the fixed plate second side, and an electrical connection arranged conductively between the first and second sides and a threaded opening between the first and second sides;

c. the second coil first electrical connection assembled on the fixed plate second side electrical connection and the coil second electrical connection assembled on the second traveler plate first side electrical connection;

d. a conductor from the fixed plate second side electrical connection and a second conductor from the traveler plate second side electrical connection, these conductors arranged to electrically connect the coil between the antenna and the radio; and e. the lead screw arranged to threadedly connect to the second traveler plate and rotatively traverse the lower fixed plate lead screw thrust collar bearing wherein rotating the lead screw in one direction moves the second traveler plate away from the lower fixed plate and rotating the lead screw in the opposite direction moves the second traveler plate toward the lower fixed plate.

15. The radio transmission and reception antenna variable inductance tuning device of claim 10 further comprising a short switch with an adjustable contact and a fixed contact arranged such that closing the contacts provides a short circuit around the coil windings and further arranged such that the contacts close at a set position of the traveler plate relative to the fixed plate.

16. The radio transmission and reception antenna variable inductance tuning device of claim 15 further comprising a short switch with an adjustable contact and a fixed contact arranged such that closing the contacts provides a short circuit around the coil windings and further arranged such that the contacts close at a set position of the traveler plate relative to the fixed plate.

17. The radio transmission and reception antenna variable inductance tuning device of claim 10 further comprising a housing arranged with electrical connections for the coil and the motor.

18. The radio transmission and reception antenna variable inductance tuning device of claim 10 further comprising an encoder arranged to monitor lead screw turns.

19. The radio transmission and reception antenna variable inductance tuning device of claim 18 further comprising a housing arranged with electrical connections for the coil and short switch, the motor, and the encoder.

20. A radio transmission and reception antenna variable inductance tuning device comprising:

a. a flexible conductor arranged in multiple helical coil windings with a first electrical connection and a second electrical connection;

b. a traveler plate with a first side and a second side and an electrical connection arranged conductively between the first and second sides and a threaded opening between the first and second sides;

c. a fixed plate with a first side and a second side, the first side arranged toward the traveler plate second side, and an electrical connection arranged between the first and second sides, and an opening between the first and second sides, the opening arranged with a lead screw thrust collar bearing;

d. the coil first electrical connection assembled on the fixed plate first side electrical connection and the coil second electrical connection assembled on the traveler plate second side electrical connection;

e. a conductor from the fixed plate first side electrical connection and a second conductor from the traveler plate second side electrical connection, these conductors arranged to electrically connect the coil between the antenna and the radio;

f. a lead screw with a round cross-section and a first end and a second end, the first end starting a threaded length and the second end starting an unthreaded length with a transition from threaded to unthreaded between the first and second ends;

g. the lead screw arranged with the threaded length threadedly engaged with the traveler plate threaded opening and the unthreaded length arranged in the lead screw thrust collar bearing in the fixed plate opening such that the lead screw bearing supportedly engages with the lead screw; and h. means for rotating the lead screw wherein turning the lead screw adjusts the position of the traveler plate relative to the fixed plate such that the spacing of the coil windings is symmetrically increased or decreased by increasing or decreasing the position of the traveler plate relative to the fixed plate.

21. The radio transmission and reception antenna variable inductance tuning device of claim 20 further comprising a housing arranged with electrical connections for the coils, the motor, and the encoder.

22. The radio transmission and reception antenna variable inductance tuning device of claim 20 further comprising a housing arranged with electrical connections for the coils, the motor, and the encoder.

23. A method of manufacturing a variable inductor for an electrical circuit comprising:

a. winding an electrical conductor with a first electrical connection and a second electrical connection into a helical coil;

b. connecting the coiled conductor first electrical connection to a traveler plate electrical connection;

c. connecting the coiled conductor second electrical connection to a fixed plate electrical connection; and d. attaching means for moving the traveler plate away from or towards the fixed plate to the traveler plate and to the fixed plate such that moving the traveler plate away from the fixed plate moves the inductor coils apart, increasing the length of the coil and moving the traveler plate towards the fixed plate moves the Inductor coils closer, decreasing the length of the coil.

24. A method of tuning a radio antenna when changing from transceiver operation at a first desired radio frequency to a second desired radio frequency comprising:

a. connecting a flexible helical coil between the antenna and the transmission line to the antenna such that the coil adjusts the antenna impedance;

b. mounting the flexible helical coil between a fixed plate and a movable traveler plate such that the flexible helical coil length may be symmetrically increased or decreased;

c. changing the operating frequency from the first desired frequency to the second desired frequency;

d. moving the traveler plate relative to the fixed plate such that the flexible helical coil spacing is symmetrically changed; and e. adjusting the traveler plate relative to the fixed plate in small increments such that the antenna is resonant at the second radio frequency.

25. The method of tuning a radio antenna when changing from transceiver operation at a first desired radio frequency to a second desired radio frequency as in claim 24 further comprising:

a. adjusting the transceiver such that the second desired radio frequency is in a frequency band at a wavelength approximately one-half the first desired radio frequency wavelength;

b. connecting a short switch with an adjustable contact and a fixed contact arranged such that closing the contacts provides a short circuit around the coil windings and further arranged such that the contacts close at a set position of the traveler plate relative to the fixed plate; and c. moving the traveler plate relative to the fixed plate such that the short switch contacts close.

* * * * *

UNITED STATES PATENT AND TRADEMARK OFFICE

CERTIFICATE OF CORRECTION

PATENT NO. : 7,176,840 B1
APPLICATION NO. : 10/907640
DATED : February 13, 2007
INVENTOR(S) : Michael Peter Kelley It is certified that error appears in the above-identified patent and that said Letters Patent is hereby corrected as shown below:

Col. 9, lines 1-17, Renumber Claim 6 as Claim 7 and replace with the following Claim 6:
6. The variable electric inductor of claim 3 further comprising a short switch with an adjustable contact and a fixed contact arranged such that closing the contacts provides a short circuit around the coil windings and further arranged such that the contacts close at a set position of the traveler plate relative to the fixed plate.

Col. 9, line 24, delete Claim 8 and add the following Claim 8:
8. The variable electric inductor of claim 6 further comprising an encoder wherein the rotations of the lead screw may be remotely decoded.

Col. 9, line 18, renumber Claim 7 as Claim 9, and change the reference in renumbered Claim 9 from Claim 6 to Claim 7. Col. 9, line 30-32, delete Claim 9.

Col. 9, line 58, delete Claim 12 and replace with the following:
12. A radio transmission and reception antenna variable inductance tuning device comprising:
a. a flexible conductor arranged in multiple helical coil windings with a first electrical connection and a second electrical connection;
b. a traveler plate with a first side and a second side and an electrical connection arranged conductively between the first and second sides and a threaded opening between the first and second sides;
c. a fixed plate with a first side and a second side, the first side arranged toward the traveler plate second side, and an electrical connection arranged between the first and second sides, and an opening between the first and second sides, the opening arranged with a lead screw thrust collar bearing;
d. the coil first electrical connection assembled on the fixed plate second side electrical connection and the coil second electrical connection assembled on the traveler plate first side electrical connection;
e. a conductor from the fixed plate first side electrical connection and a second conductor from the traveler plate second side electrical connection, these conductors arranged to electrically connect the coil between the antenna and the radio;
f. a lead screw with a round cross-section and a first end and a second end, the first end starting a threaded length and the second end starting an unthreaded length with a transition from threaded to unthreaded between the first and second ends;
g. the lead screw arranged with the threaded length threadedly engaged with the traveler plate threaded opening and the unthreaded length arranged in the rlead screw thrust collar bearing in the fixed plate opening such that the lead screw suportedly engages with the lead screw; and

UNITED STATES PATENT AND TRADEMARK OFFICE

CERTIFICATE OF CORRECTION

PATENT NO. : 7,176,840 B1
APPLICATION NO. : 10/907640
DATED : February 13, 2007
INVENTOR(S) : Michael Peter Kelley It is certified that error appears in the above-identified patent and that said Letters Patent is hereby corrected as shown below:

h. means for rotating the lead screw wherein turning the lead screw adjusts the position of the traveler plate relative to the fixed plate such that the spacing of the coil windings is symmetrically increased or decreased by increasing or decreasing the position of the traveler plate relative to the fixed plate.

Col. 10, line 18, delete Claim 13 and replace with the following:
13. The radio transmission and reception antenna variable inductance tuning device of claim 12 further comprising an encoder arranged to monitor lead screw turns.

Col. 10, line 57, renumber Claim 16 as Claim 18.
In Renumbered Claim 18 change the reference from 15 to claim 17.

Col. 10, line 64, delete Claim 17 and insert the following Claims 16 and 17 before Renumbered Claim 18:
16. The radio transmission and reception antenna variable inductance tuning device of claim 12 further comprising a housing arranged with electrical connections for the coil and the motor.

17. The radio transmission and reception antenna variable inductance tuning device of claim 13 further comprising:

a. a second flexible conductor arranged in multiple helical coil windings with a first electrical connection and a second electrical connection;
b. a second traveler plate with a first side and a second side, the first side arranged toward the fixed plate second side, and an electrical connection arranged conductively between the first and second sides and a threaded opening between the first and second sides;
c. the second coil first electrical connection assembled on the fixed plate second side electrical connection and the coil second electrical connection assembled on the second traveler plate first side electrical connection;
d. a conductor from the fixed plate second side electrical connection and a second conductor from the traveler plate second side electrical connection, these conductors arranged to electrically connect the coil between the antenna and the radio; and
e. the lead screw arranged to threadedly connect to the second traveler plate and rotatively traverse the lower fixed plate lead screw thrust collar bearing wherein rotating the lead screw in one direction moves the second traveler plate away from the lower fixed plate and rotating the lead screw in the opposite direction moves the second traveler plate toward the lower fixed plate.

UNITED STATES PATENT AND TRADEMARK OFFICE

CERTIFICATE OF CORRECTION

PATENT NO. : 7,176,840 B1
APPLICATION NO. : 10/907640
DATED : February 13, 2007
INVENTOR(S) : Michael Peter Kelley It is certified that error appears in the above-identified patent and that said Letters Patent is hereby corrected as shown below:

Col. 11, line 1, delete Claims 18 and 19 and insert the following Claim 19:
19. The radio transmission and reception antenna variable inductance tuning device of claim 13 further comprising a housing arranged with electrical connections for the coil, the motor, and the encoder.

Col. 11, line 8, delete Claim 20 and replace with the following Claim 20:
20. The radio transmission and reception antenna variable inductance tuning device of claim 14 further comprising a housing arranged with electrical connections for the coils, the motor, and the encoder.

Col. 11, line 49, delete Claim 21 and replace with the following Claim 21:
21. The radio transmission and reception antenna variable inductance tuning device of claim 15 further comprising a housing arranged with electrical connections for the coil and short switch, the motor, and the encoder.

In Claim 22, Col. 11 line 54, Replace the reference to Claim 20 with Claim 17.

Signed and Sealed this

Tenth Day of June, 2008

Jon W. Dudas

JON W. DUDAS
*Director of the United States Patent and Trademark Office*